United States Patent [19]

Lucas

[11] Patent Number: 4,596,636

[45] Date of Patent: Jun. 24, 1986

[54] METHOD FOR THE ELECTRODEPOSITION OF METAL AND METHOD OF WORKPIECE PRETREATMENT THEREFOR

[75] Inventor: Stephen G. Lucas, Shell Beach, Calif.

[73] Assignee: Alumatec, Inc., Grover City, Calif.

[21] Appl. No.: 642,094

[22] Filed: Aug. 20, 1984

[51] Int. Cl.[4] ..... C25D 5/34

[52] U.S. Cl. ..... 204/58.5

[58] Field of Search ..... 204/58.5, 32.1, 215

[56] References Cited

U.S. PATENT DOCUMENTS

| | | | |
|---|---|---|---|
| 3,969,195 | 7/1976 | Dotzer | 204/58.5 |
| 4,066,515 | 1/1978 | Stoger | 204/58.5 |
| 4,382,844 | 5/1983 | Berkle | 204/58.5 |
| 4,392,936 | 7/1983 | Stoeger | 204/213 |

FOREIGN PATENT DOCUMENTS

| | | | |
|---|---|---|---|
| 2719680 | 11/1978 | Fed. Rep. of Germany | 204/58.5 |

*Primary Examiner*—T. M. Tufariello

*Attorney, Agent, or Firm*—Drucker & Sommers

[57] ABSTRACT

Improved apparatus and method for the electrodeposition of aluminum and its alloys using aprotic, oxygen and water-free organoaluminum electrolytes, involving a method for removing water from pretreated workpieces and locating them in a plating barrel without exposure of workpieces to air, and further utilizing a rotatable, triple-chambered treatment barrel which provides a greater ratio of anode to cathode surface area and also decreased spacing between anode and cathode, and further applying centrifugal force to the treatment barrel to assist the draining and removal of electroplating and rinse solvents.

3 Claims, 3 Drawing Figures

18
21
19
3
20
46
45
49
44
6
1
41
35
48
34
32
42
7
47
8
30
31

METHOD FOR THE ELECTRODEPOSITION OF METAL AND METHOD OF WORKPIECE PRETREATMENT THEREFOR

BACKGROUND OF THE INVENTION

This invention relates to an apparatus and method for the electrodeposition of aluminum and its alloys onto surfaces of electrically conductive materials, using an aprotic, oxygen-free, water-free organoaluminum electrolyte, and more specifically to an improved apparatus and method of this nature for pretreating and then coating tumbling work pieces of any design in a controlled air-tight and water-free environment.

Reactive metals such as aluminum are electrodeposited from many aprotic, oxygen-free organoaluminum electrolytes. Removal of all surface oxides and water from the basis metal before and during electroplating greatly facilitates adhesion of the aluminum deposit.

Early attempts to deposit aluminum using open containers were inefficient because the organoaluminum electrolytes react rapidly with oxygen and moisture in the air, causing the electrolyte to lose conductivity and useful life. Therefore, most current state of the art aluminum electrodeposition is conducted in liquid and gas-tight chambers to enhance the life of the electrolyte. Some provide airlock chambers between the electroplating chamber and the solvent inlet and outlet means to avoid or reduce the introduction of air and water into the electroplating chamber during the filling and draining steps. These systems generally provide for the placing of pretreated, water-free workpieces into a chamber with a water and air-free inert solvent, replacing the solvent with inert gas, and then filling the plating chamber with electrolyte and electroplating. Examples of such systems are shown in U.S. Pat. Nos. 4,066,515 and 4,392,936.

The main disadvantages in the prior art are the difficulty in pretreating workpieces so as to render them free from water and air, the large dragout volumes of the various treatment liquids (the volume retained of the drainage due to adherence to the barrel and the workpieces), the difficulty of operator access to the plating cell (for the charging and emptying of cathode work pieces and for routine maintenance such as replacing aluminum anode material). Another disadvantage, which is important but not immediately obvious, results from the use of the relatively low conductance, high capacitance solutions associated with non-aqueous aluminum plating electrolytes. Generally, the ratio of the anode to cathode surface area is relatively low, and the cathode to anode spacing is relatively large. Thus, relatively high voltages have been needed to accomplish the electrodeposition, causing increased electrical consumption, decreased maximum attainable current density, and loss of plating efficiency.

SUMMARY OF THE INVENTION

It is therefore the object of this invention to overcome some of the problems associated with the prior art, as well as to provide a more efficient aluminum electroplating device by providing a novel hot solvent pretreatment, increasing the ratio of anode to cathode surface area and also by decreasing the spacing between anode and cathode, as well as reducing the dragout volume of the treatment liquids.

Workpieces are pretreated by placing them into a bath of hot solvent, a film of said bath remaining as a coating on the workpieces if they are transferred from the pretreatment bath to the plating barrel.

The apparatus of the invention preferably employs a heatable treatment barrel containing three concentric chambers which is mounted for rotation about a horizontal axis, and can also be rotated 180 degrees about a vertical axis. The treatment barrel can be opened and closed airtight via a hinged lid and a clamping device. One end of the barrel is fitted with a rotatably-mounted liquid joint to allow various treatment liquids to be pumped in and out of the barrel. The other end of the treatment barrel is fitted with a two-conductor electrical contact to provide continuous current to an anode and a cathode section in the barrel during rotation.

The radially-innermost chamber within the treatment barrel comprises a perforated non-conductive plating drum into which the workpieces to be plated are placed. These workpieces are rendered cathodic during the plating procedure. Surrounding the plating drum is the radially-middle chamber, comprising an anodic section which is preferably filled with aluminum pellets in electrical contact with the anodic leg of the power supply. A metal screen is provided between the anode pellets and an outermost metal shell (thus forming the radially-outermost chamber) to provide a channel for treatment liquids to flow during centrifugal forced drain cycles.

DETAILED DESCRIPTION OF THE INVENTION

Figure 1:
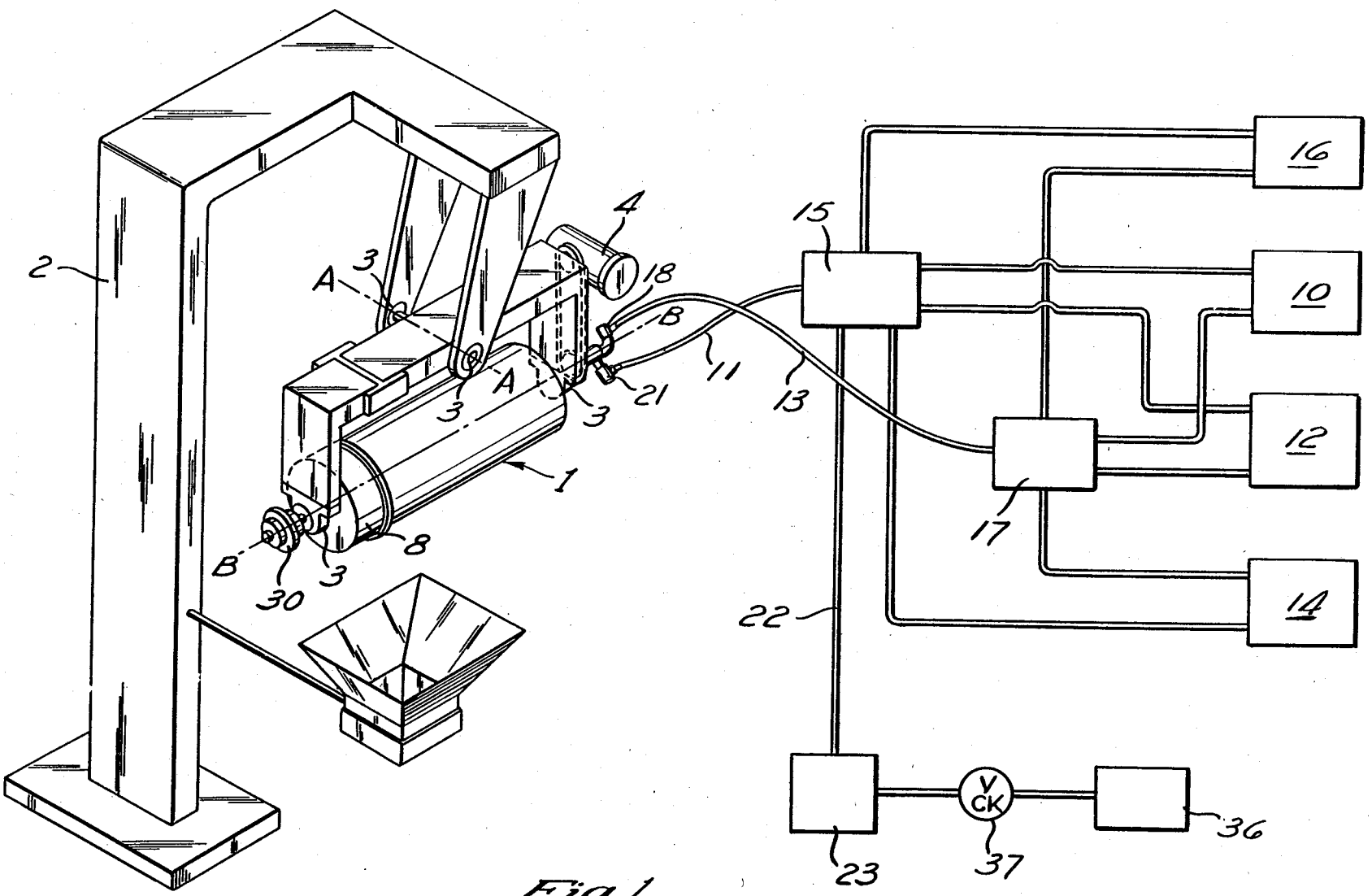
FIG. 1 is a view of the apparatus for the deposition of aluminum, partly schematic and partially in perspective.

Referring to the drawings in this case, it may be seen that one aspect of the invention is directed toward an improved apparatus for metal electrodeposition generally described above. FIG. 1 shows a treatment barrel 1 suspended by a support structure 2 in such a way that it can be rotated about support bearings 3,3. The barrel 1 can be rotated clockwise or counterclockwise 90 degrees about a horizontal axis A—A from the position pictured. The treatment barrel can also be rotated freely about its horizontal axis B—B by means of a variable speed gear motor and belt drive 4.

The barrel 1 is arranged above and is connected to solvent storage tanks 10, 12, electrolyte storage tank 14, and inert gas feed container 16, through flexible lines 11 and 13 and multiway control valves 15 and 17, respectively. Liquid is pumped from the storage tanks 10, 12, and 14 into the treatment barrel 1 via the inlet multiway valve 17, then through flexible line 13, and rotatable connector 18, up the inside of liquid joint 19 and through flow distribution spider 20. Return liquids from barrel 1 flow down the outside cavity of liquid joint 19, out through rotating conector 21, down flexible return line 11, and back to storage tanks 10, 12 and 14 through multiway outlet valve 15. The treatment liquids can be forced into the treatment barrel by either inert gas pressure or by feed pump.

The treatment barrel 1 is also connected through the outlet multiway valve 15 to a gas vent line 22 and sight gauge 23 to a vent bubbler 36 which becomes filled with an inert liquid when all air has been displaced from the treatment barrel. Any air displaced from the treatment barrel 1 is vented through the sight gauge 23 and out to the atmosphere through an oil-filled vent bubbler 36 or other aprotic sealing liquid, and is prevented from being accidentally sucked back into the system by check valve 37.

The electrolyte storage tank 14 and solvent rinse tanks 10 and 12 are heatable to operating temperatures of 100°-150° centigrade by conventional flexible strip heaters (not shown) and is continuously filtered through conventional bypass filters (not shown). Conventional pumps (not shown ) are used for circulating electrolyte and rinse solvents through the treatment barrel and bypass filters.

Figures 2, 3:
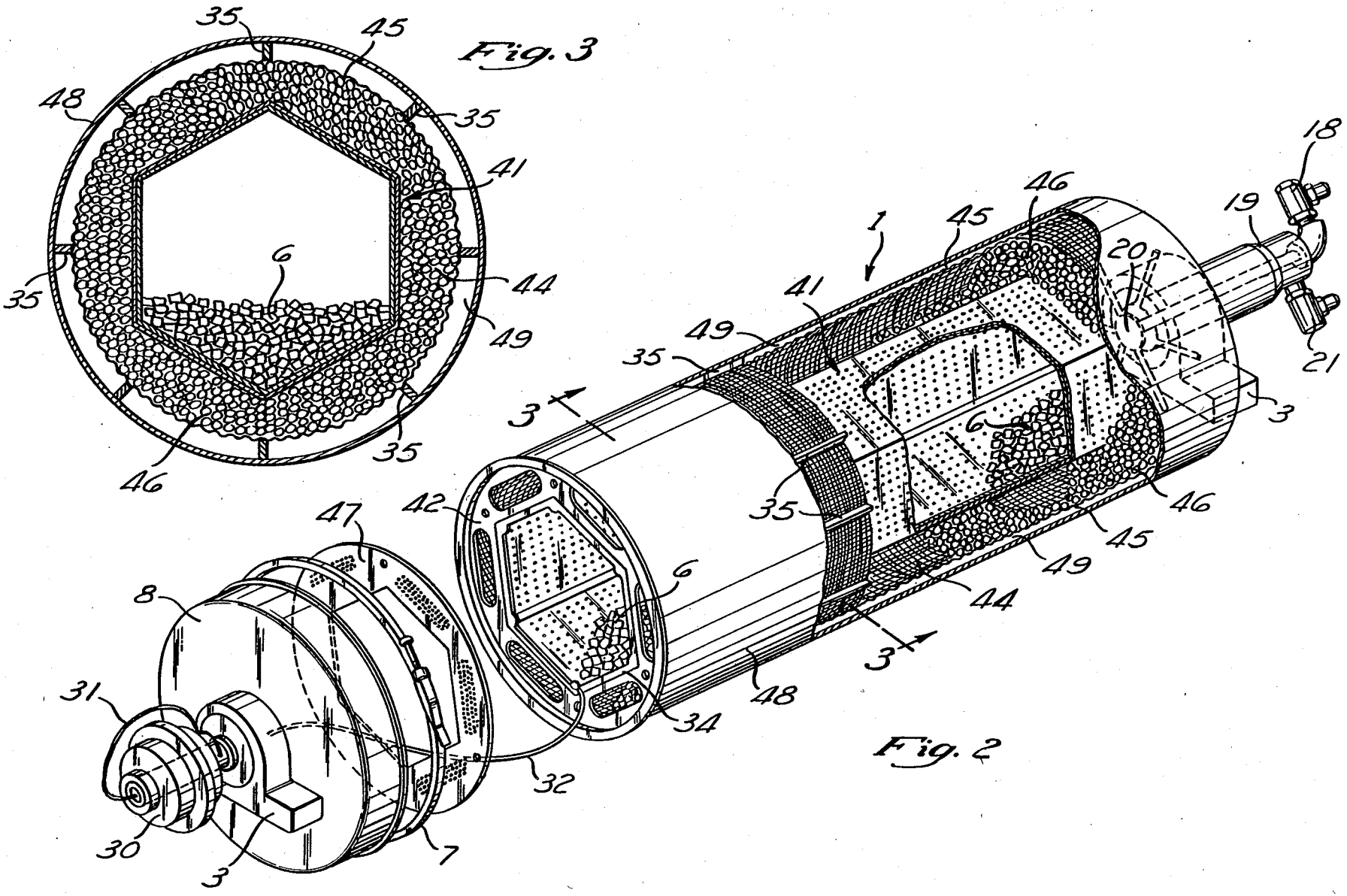
FIG. 2 is a perspective view, partly broken away, of the treatment barrel used for the electrodeposition of aluminum.
FIG. 3 is a transverse cross section of the treatment barrel taken along line 9—9 of FIG. 2.

FIGS. 2 and 3 show the treatment barrel in greater detail and represent, respectively, the horizontal and vertical cross sectional-views. The treatment barrel 1 consists of three concentric, relatively closely-spaced chambers. The radially innermost chamber is enclosed by a perforated non-conducting plating drum 41 adapted to contain the workpieces 6 to be plated. Preferably this plating drum is hexagonally-shaped, and is connected to the negative side of the electrical circuit so as to render said workpieces cathodic. Said plating drum 41 is provided with end plate 42 for access into said drum for filling and removal of workpieces.

Surrounding the plating drum is the radially-middle chamber 44, defined by enclosure within a mesh metal screen 45 connected to the positive side of the electric circuit so as to render said middle chamber anodic. Said chamber is filled with aluminum anode material 46, preferably in the form of pellets or other pieces of a size which facilitates their removal from the chamber for routine maintenance. End plate 47 is provided for access to the aluminum anode material 46 for routine maintenance.

Said mesh metal screen 45 is in electrical contact with the outermost metal shell 48 of the treatment barrel through conductive spacers 35, which preferably are rectangular metal rods running the length of the mesh metal screen. The channel 49 thus provided between the mesh metal screen and the outermost metal shell forms the third and radially-outermost chamber. Said chamber is maintained to allow treatment liquids to flow during centrifugal-forced drain cycles. The outermost metal shell 48 is preferably cylindrical in shape.

A cap 8 encloses one end of the barrel. Cap 8 can be opened for access to the plating drum 41 and anode chamber 44 and can be sealed airtight with a clamp 7.

Electrical connection is made through a rotatable twoconductor slip ring 30. The cathode connection is made through the center of the plating cap 8 and through flexible connector 32 to either a cathode contact cage 34 or a cathode dangler (not shown) which is in electrical contact with the cathode workpieces 6. The anode connection can be made through flexible connector 31 to the outer metal shell 48 which is in electrical contact with the aluminum anode material 46 through conductive metal spacers 35, which preferably are rectangular metal rods running the length of the anode chamber. Alternatively, the anode connection can be made through the center of the plating cap 8 through a flexible connector (not shown but similar to cathode connector 32) in electrical contact with the aluminum anode material 46.

In accordance with further features of the invention, the described apparatus is operated in the following manner:

The treatment barrel 1 is arranged so that the inlet and outlet lines to the storage tanks are on the bottom. This is called the upright position. The barrel cap 8 is opened and the treatment barrel is filled to about $\frac{2}{3}$ of its volume with inert solvent. Suitable solvents to be used with the organoaluminum electrolytes are toluene, napthalene and their alkyl derivatives.

It is preferred that the inert solvent be at a temperature substantially above the boiling point of water or its azeotropes with such liquids as methanol, ethanol, isopropyl alcohol or acetone (110°-150° centigrade).

The workpieces are cleaned or prepared by standard techniques involving water and alcohols, and then rinsed with a water displacement liquid. Suitable water displacement liquids are napthalene and its alkyl derivatives, and other high-boiling-point aromatic hydrocarbons such as tetracene, pyrene, anthracene and phenanthrene. The water displacement liquid is preferrably used at a temperature substantially above the boiling point of water of its azeotropes with such liquids as methanol, ethanol, isopropyl alcohol or acetone (110°-150° centigrade), and below the boiling point of the aromatic hydrocarbon.

The workpieces are placed into the hot solvent, and any water, alcohol or water/alcohol azeotropes are immediately boiled off, thus leaving water and oxygen-free work pieces. Further, an air and/or water-reactive material such as sodium metal may be added to the hot solvent to react with any water or alcohol which may not have been boiled away; such reaction products as are formed would be insoluble in the inert solvent and thus can be removed from the solvent by filtration.

This hot solvent liquid has a comparatively low vapor pressure and a high temperature, so that, after evaporating any water or alcohol, the solvent remains as a protective coating on the workpieces.

Workpiece pretreatment can take place either in the same location as the electroplating will be done, or in a separate pretreatment zone. If the pretreatment is to take place in the electroplating zone, the following procedure is followed. First workpieces are cleaned with standard techniques involving water and alcohol. Secondly, the workpieces are placed into the treatment barrel which contains enough hot displacement liquid to cover the workpieces. The volume and temperature of the hot displacement liquid should be sufficient enough so that when the relatively cool workpieces are immersed, the resulting temperature of the displacement liquid does not fall below 212° F. Any water, alcohol or water/alcohol azeotropes are boiled off as described above. The lid to the treatment barrel is then closed and sealed air and liquid tight. The remaining air in the treatment barrel is then purged out by filling the treatment barrel with additional hot displacement liquid. At this point, the workpieces may be additionally rinsed by pumping hot displacement liquid through the barrel while the workpieces are tumbled in a horizontal position. After the solvents are drained out, the treatment barrel is filled with electrolyte as described below in electroplating procedures.

Although pretreatment can take place in the treatment barrel, this pretreatment method is clearly advantageous when the workpiece pretreatment is done in a container apart from the treatment barrel, and the transference of the workpieces from the pretreatment bath to treatment barrel involves exposure to air and water condensation on the workpieces. If the pretreatment is done apart from the treatment barrel, the pretreated workpieces are then transferred to the treatment barrel, which is filled with hot solvent as described above, and the method of electrodeposition continues as follows.

After the workpieces have been dewatered, as described above, the cap to the treatment barrel is closed airtight with clamp 7 and the barrel is inverted so that the inlet and outlet connections are at the top. This is called the inverted position. All air that is remaining in the treatment barrel is then purged out to the atmosphere through conventional sight gauges and vent bubblers until solvent appears in the sight glass, indicating that the treatment barrel is full. The solvent is then drained from the treatment barrel and relocated into the solvent storage tank via gravitational drain.

A centrifugal forced spin is advantageously supplied during drainage to help remove solvent from the treatment barrel by forcing it toward the outer wall, where it drains down the channel 49 between the outermost metal shell and the perforated anode support screen. Hot inert gas may also be blown through the treatment barrel to facilitate drainage.

As the solvent empties from the treatment barrel, said barrel is filled with inert gas. This inert gas in turn is replaced in the treatment barrel by preheated aluminum plating electrolyte from storage tank 14. The barrel is rotated to a horizontal position, and the plating current is turned on. During the plating cycle, the treatment barrel is rotated at approximately 6–9 rpm, and aluminum plating electrolyte is continuously circulated through the treatment barrel by a pump (not shown). When the electrodeposition of aluminum is complete, the treatment barrel is rotated back to the upright position and electrolyte is drained back into the electrolyte storage tank in the same manner as the initial solvent rinse described above.

The treatment barrel is inverted and filled with rinse solvent from tank 10 or 12. The barrel is returned to the horizontal position and rotated about the horizontal axis, so that the plated parts are tumbled while rinse solvent is circulated through the barrel by pump (not shown). Generally, after two to five minutes, the pump is shut off and the treatment barrel is returned to the upright position and the rinse solvent is drained back into the solvent storage tank 10 or 12 with the aid of a centrifugal forced spin cycle, as described above. Preferably two or more solvent rinses are employed to remove all traces of electrolyte from the plated workpieces before they are removed.

Hot inert gas may be circulated through the treatment barrel during the drain cycles to further remove the electrolyte or other solvent.

Following rinsing, the cap 8 to the treatment barrel 1 is opened by removing the clamp 7. The treatment barrel is inverted and the finished workpieces are unloaded into a container which is suspended under a parts catcher 5. The treatment barrel is returned to the upright positon and is ready for the next plating cycle.

I claim:

1. A method for the pretreatment of workpieces to be electroplated, comprising:

(a) the placing of said workpieces into a bath with high-boiling-point aromatic hydrocarbons;

(b) heating and maintaining the temperature of said liquid bath to a temperature substantially above the boiling point of water, alcohol, or water/alcohol-/azeotropes but below the boiling point of said hydrocarbon; and (c) allowing the workpieces to remain in said bath for a time sufficient to allow any water, alcohol, or water/alcohol azeotropes to boil away.

2. A method for the pretreatment of workpieces to be electroplated, as in claim 1, and further removing said liquid bath from the pretreatment zone, substituting therefor an electrolyte, then electroplating.

3. A method for the pretreatment of workpieces to be electroplated, as in claim 1, and further removing said workpieces from the pretreatment zone, placing them into an electroplating treatment zone, and electroplating.

* * * * *